US006698585B2

(12) United States Patent
Kammerer

(10) Patent No.: US 6,698,585 B2
(45) Date of Patent: Mar. 2, 2004

(54) COMPACT POUCH CONTAINER AND ORGANIZER FOR PASTELS

(76) Inventor: Dagmar C Kammerer, 1861 E. Shore Dr., Green Bay, WI (US) 54302

( * ) Notice: Subject to any disclaimer, the term of this patent is extended or adjusted under 35 U.S.C. 154(b) by 122 days.

(21) Appl. No.: 10/135,029

(22) Filed: May 1, 2002

(65) Prior Publication Data

US 2003/0205486 A1 Nov. 6, 2003

(51) Int. Cl.[7] ..... B65D 85/20
(52) U.S. Cl. ..... 206/1.7; 206/443; 206/478
(58) Field of Search ..... 206/1.7–1.9, 81, 206/443, 478, 479, 575

(56) References Cited

U.S. PATENT DOCUMENTS 1,508,204 A * 9/1924 Walker ..... 206/581
2,535,229 A * 12/1950 Paolantonio ..... 206/472
2,718,447 A * 9/1955 Wright ..... 312/241
4,616,748 A * 10/1986 Thomas et al. ..... 206/214
4,822,118 A * 4/1989 Watkins ..... 312/244
5,799,791 A * 9/1998 Harley ..... 206/478
5,860,518 A * 1/1999 Axelrod ..... 206/224

* cited by examiner

*Primary Examiner*—Jim Foster

(57) ABSTRACT

A container for artist's pastels which is comprised of a rectangular pad onto which is attached an elastic loop system. Pastels are inserted into the loops of the elastic. To close, the pad is rolled up from the bottom and placed into aperture of the pouch that is attached to the top of the pad. The pouch is closed with a zipper and carried by an adjustable shoulder strap.

1 Claim, 6 Drawing Sheets

COMPACT POUCH CONTAINER AND ORGANIZER FOR PASTELS

FIELD OF THE INVENTION

This invention relates to the artist's containers specifically used to transport sticks of pastels to classrooms, studios, or in the field. More specifically this invention relates to a pouch style container and system that can be used to improve transportability and minimize space requirements when in use.

BACKGROUND OF THE INVENTION

A pastel artist needs to have available many sticks of pastels as they cannot be mixed to produce different colors as in oils and watercolors.

Therefore pastel containers must have room to accommodate the many needed pastels plus provide protection and accessibility. If the container is heavy and cumbersome it causes great difficulty for the artist, often limiting amounts of supplies that can be carried. Surface space on which to place open containers is often limited in the classroom or studio so the artist is prohibited from laying out supplies for easy accessibility.

A system that satisfies all the necessary needs but is light, compact, and easy to transport and use will greatly improve the artist's productivity and the quality of work.

DESCRIPTION OF PRIOR ART

The most popular containers are constructed of wood, plastic, or cardboard formed in rigid box-type shape. They are cumbersome, large, awkward, and heavy causing great difficulty in transporting.

When open for use, much surface space is needed to accommodate the extended rigid trays.

They do satisfy the following requirements:

a) They provide protection for the delicate pastels from water and damage.

b) They enable organization of pastels.

c) Pastels can be removed and replaced easily.

d) Some have a system that will clean pastels and remove pastel dust.

SUMMARY OF THE INVENTION

The present invention overcomes the problems associated with prior art by eliminating the rigid box-type style while incorporating all the previously stated requirements.

This is due to the unique nature of the pouch carry system in which a fleece pad holds the pastels in loops formed by bands of elastic. The pad is rolled up and inserted into the aperture of the attached pouch. It is closed and fastened with a zipper. The strap attached to the pouch can be held over the shoulder or slung over the back thereby freeing the hands to carry other art supplies. The resulting pouch system is compact, light, and easily transported. This feature can be understood by quoting the measurements, which are:

Closed;

a) Length is 18 inches b) Diameter is 6 inches c) Weight, complete with pastels is below 5 pounds.

Open for use;

a) Width is 18 inches b) Length is 30 inches

Another unique feature of this design is that the pouch can be hung by means of the shoulder strap, either in the closed or open position, since the pastels are held securely by the elastic loop system.

In summary the pouch design solves two problems.

a) It affords easy transportation.

b) It reduces the need for large surface areas while in use.

The design also incorporates the important features of the prior art.

a) The material for the pouch and outer shell is moisture-proof.

b) The fleece pad, the outer shell and pouch provide protection.

c) A minimum of 100 sticks of pastels can be contained.

d) The pastels are easily organized and can be maintained with little effort.

e) The pastels are easily inserted and removed.

f) Cleaning is automatically accomplished when the pastel is inserted into a loop.

g) Pastel dust is collected into the fleece pad.

DETAILED DESCRIPTIONS OF THE DRAWINGS

Figure 1:
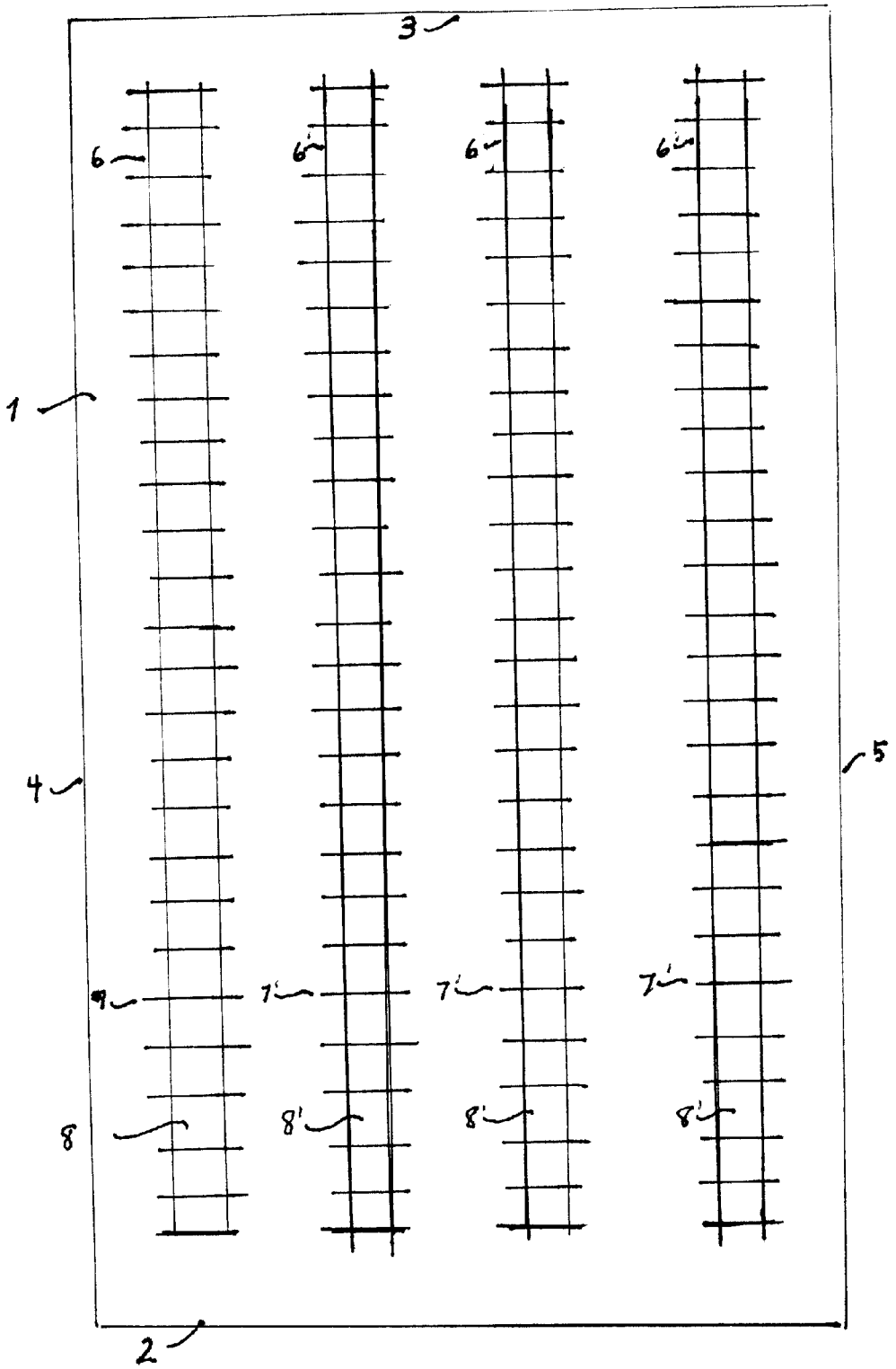
FIG. 1 is a plan view of the fleece pad showing elastic bands sewn into position which form loops into which pastels are inserted.

Referring to FIG. 1 is a plan view of the fleece pad 1 which has a bottom edge 2, top edge 3, left side edge 4, and right side edge 5. Four bands of elastic 6 are placed vertically on the fleece pad 1. They are sewn into place by multiple rows of stitching 7, which extend the full length of the bands of elastic 6. The spaces 8 between the rows of stitching form the loops into which the pastels are placed.

Figure 2:
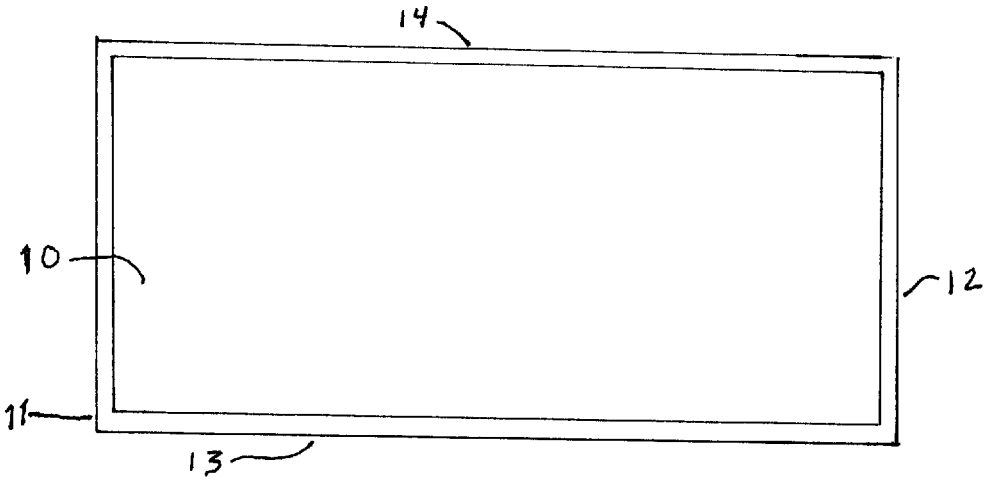
FIG. 2 is a plan view of the outer shell showing the first step of construction.

Referring to FIG. 2 is a plan view of the first step in the construction of the outer shell 10. A rectangular piece of fabric is hemmed on left edge 11, right edge 12, bottom edge 13, and top edge 14.

Figure 3:
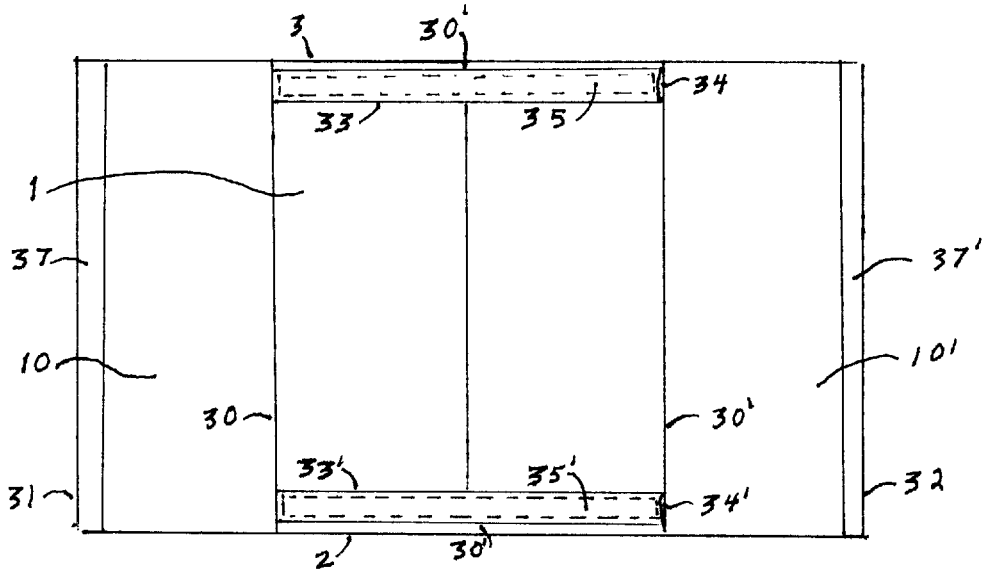
FIG. 3 is a plan view of the outer shell in open position after fleece pad and strips of velcro have been sewn into position.

Referring to FIG. 3 is a plan view illustrating the position of the fleece pad 1 in the middle of the outer shell 10. Stitching line 30 indicates the stitching of fleece pad 1 to outer shell 10. The outer shell 10 extends out horizontally from both sides of the fleece pad 1 forming a left flap 31 and a right flap 32. Directly below the top edge 3 of the fleece pad 1 is a horizontal row of stitching 33 which forms a pocket 34 into which a strip of plastic 35 is inserted to prevent the fleece pad 1 from curling. Directly above bottom edge 2 of the fleece pad 1 is a horizontal row of stitching 33 which also forms a pocket 34 into which another strip of plastic is inserted to prevent the fleece pad 1 from folding. The vertical row of stitching 36 up the middle of the fleece pad 1 anchors it to the outer shell 10. Velcro strips 37 are sewn onto the left edge 31 and right edge 32 of the outer shell 10 for fastening together over the fleece pad 1.

Figure 4:
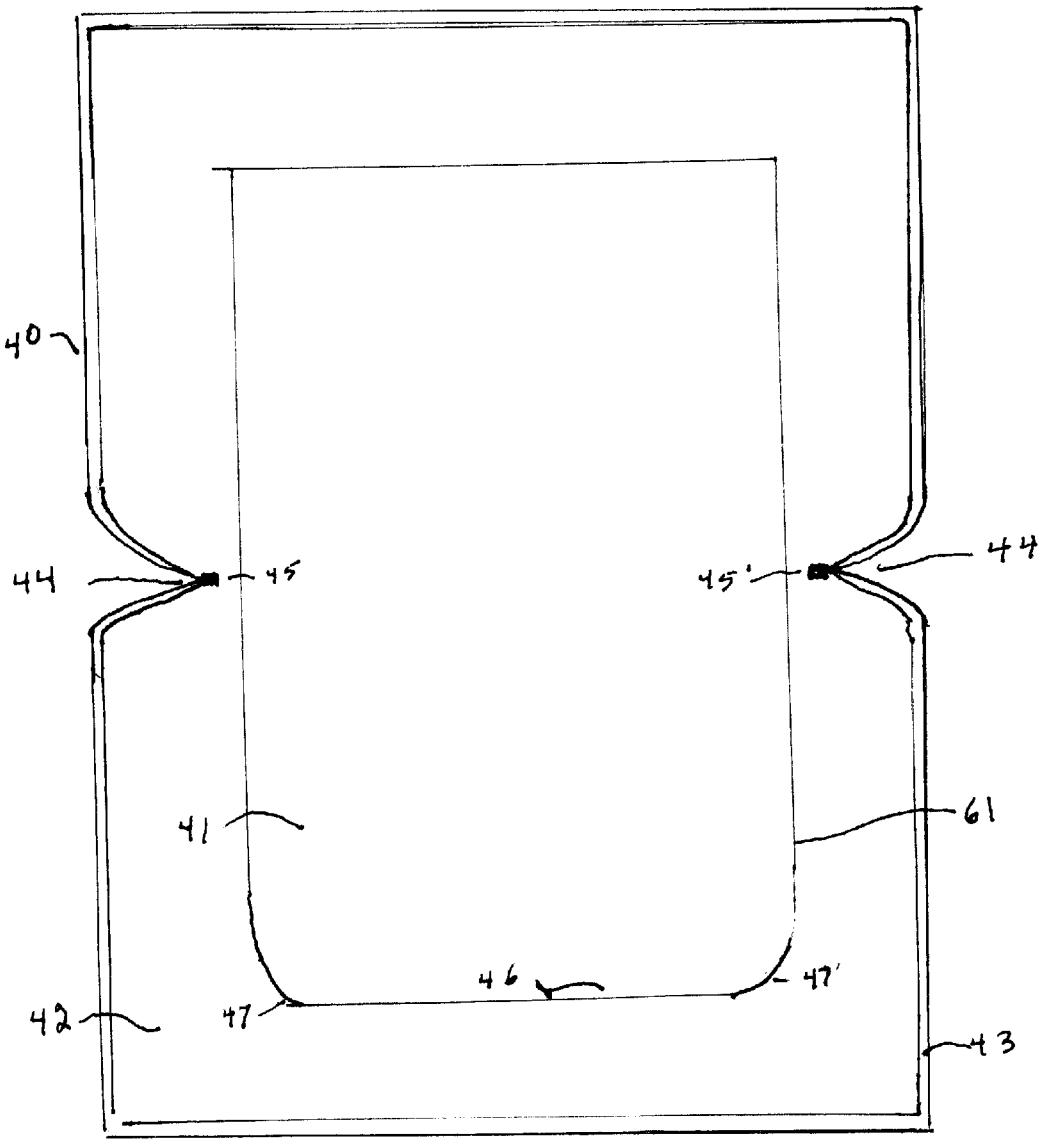
FIG. 4 is a plan view of the open pouch after it has been constructed.

Referring to FIG. 4 is a plan view of the open pouch 40, which is made of a body 41, a border strip 42 and a zipper 43. The body 41 is a rectangular piece of fabric around which the border strip of fabric 42 has been attached by seam 61. At the midpoint of the long sides of the border strip 42, slits 44 are made to create edges onto which the zipper 43 is attached continuing around all edges of the border strip. The zipper 43 clamps 45 are placed at the bottom point of the slits 44. The bottom edge of the body 41 has rounded corners 47 for softer contour and easier handling.

Figure 5:
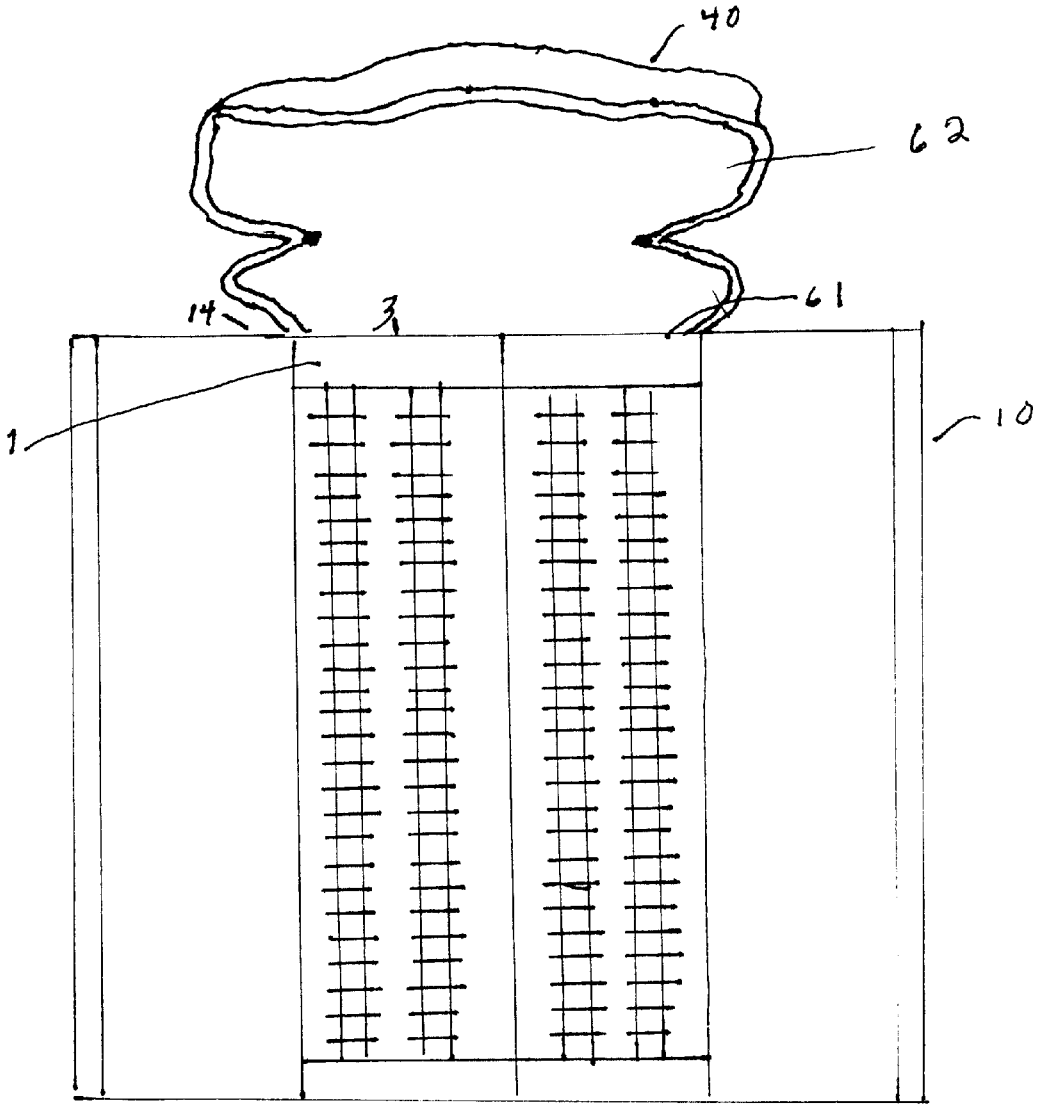
FIG. 5 is a plan view of the open pouch, outer shell, and fleece pad after construction has been completed.

Referring to FIG. 5 is the plan view of the assembled open pouch 40, outer shell 10, and fleece pad 1. The top of the fleece pad 3 and the upper edge 14 of the outer shell 10 which backs the fleece pad 1 have been sewn into the aperture 62 of the pouch 40 by means of seam 61.

Figure 6:
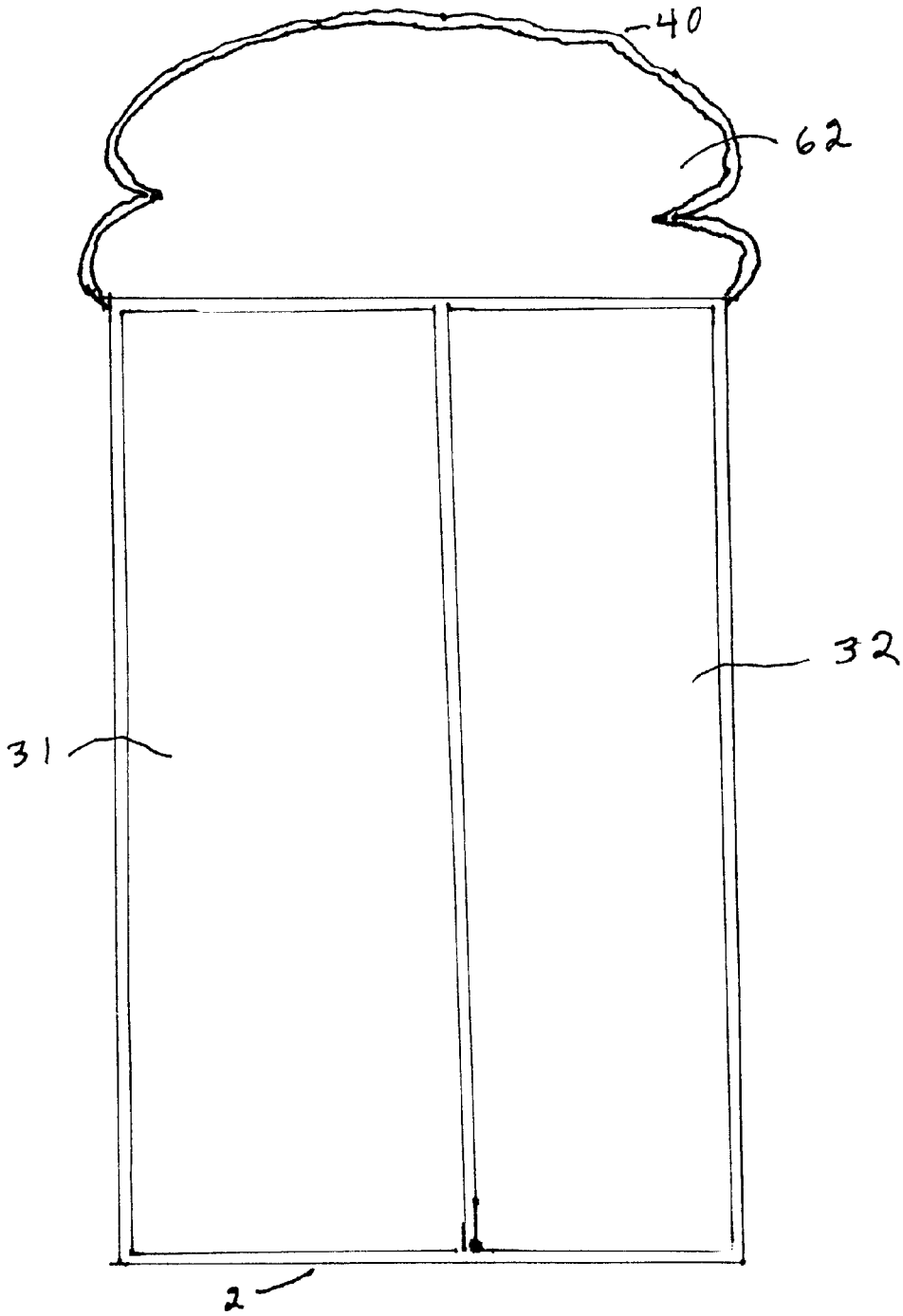
FIG. 6 is a plan view showing the outer shell flaps closed over the fleece pad prior to be rolled up and inserted into the aperture of the pouch.

Referring to FIG. 6 is a plan view demonstrating the procedure followed to close the construction. Right flap 32 is closed over fleece pad 1, left flap 31 is then fastened over right flap 32 by means of velcro strips 37. The bottom edge 2 of fleece pad 1 is then rolled up and inserted into aperture 62 of the pouch 40.

Figure 7:
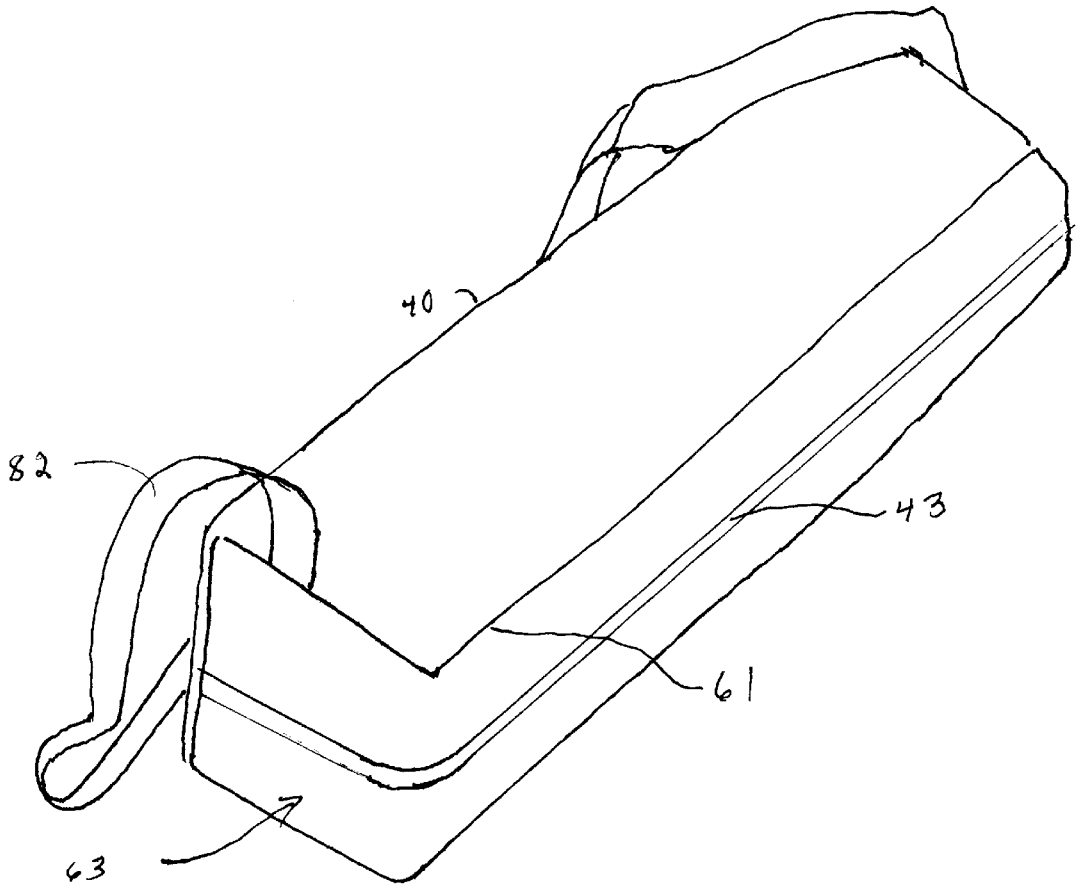
FIG. 7 is a front perspective view of the closed pouch fastened by a zipper. Also shown is the end section of the pouch showing attachment of the shoulder strap.

FIG. 7 is a front perspective view of the pouch 40 closed by means of the zipper 43, The ends of the shoulder strap 82 are sewn into seam 61 which extends down the side piece 63 of the pouch 40.

What is claimed is:

1. A compact container and organizer for artist's pastels comprising:

(a) an elastic loop system attached to a protective pad which holds the pastels securely in place (b) a moisture-proof outer shell backing the pad and extending horizontally from each side of the pad forming flaps which cover the pad when it is closed (c) an attached moisture-proof pouch into which the pad is rolled up and then inserted into the aperture of the pouch (d) a zipper which closes and fastens the pouch (e) an adjustable shoulder strap for carrying the pouch whereby the container is easily transported as it is compact and light-weight whereby a minimal surface area is needed when open for use due to the compact nature of the loop system and pad whereby the pastels are cleaned automatically by being inserted into the elastic loops whereby the pastels are organized according to the preference of the artist and easily maintained through the use of the loop system whereby the basic elements of protection, accessibility and organization present in prior art are retained in this container but the difficulties of carrying and using rigid, large, and heavy containers is eliminated.

* * * * *